United States Patent [19]

Pellman et al.

[11] Patent Number: 4,940,072

[45] Date of Patent: Jul. 10, 1990

[54] REMOVING PATTERN MATERIAL FROM INVESTMENT CASTING MOLDS

[75] Inventors: Mark A. Pellman, Orefield; Paul T. Kilhefner, III, Wescosville; Terrence S. Hahn, Allentown, all of Pa.

[73] Assignee: Air Products and Chemicals, Inc., Allentown, Pa.

[21] Appl. No.: 359,244

[22] Filed: May 31, 1989

[51] Int. Cl.[5] ..... B22C 9/04

[52] U.S. Cl. ..... 164/35; 164/34

[58] Field of Search ..... 164/34, 35, 36, 44

[56] References Cited

U.S. PATENT DOCUMENTS

| | | | |
|---|---|---|---|
| 2,459,780 | 1/1949 | McBee et al. | 260/648 |
| 3,226,785 | 1/1966 | Moxlow et al. | 164/36 |
| 3,996,991 | 12/1976 | Ugata et al. | 164/35 |
| 4,240,493 | 12/1980 | Wilmarth | 164/35 |
| 4,356,859 | 11/1982 | Savage | 164/244 |
| 4,549,686 | 10/1985 | Sargent et al. | 228/242 |
| 4,603,728 | 8/1986 | Rousseau | 164/237 |
| 4,651,799 | 3/1987 | Chandley | 164/35 |
| 4,691,754 | 9/1987 | Trumbauer et al. | 164/9 |
| 4,700,760 | 10/1987 | Weingarten | 164/244 |
| 4,777,996 | 10/1988 | Finelt | 164/237 |
| 4,809,761 | 3/1989 | Nankee et al. | 164/36 |

FOREIGN PATENT DOCUMENTS

| | | | |
|---|---|---|---|
| 2110204A | 6/1983 | United Kingdom . | |
| 2126148 | 3/1984 | United Kingdom | 164/44 |
| 2194231A | 3/1988 | United Kingdom . | |

OTHER PUBLICATIONS

Tetrahydran; 1963; vol. 19; pp. 1893 & 1899; "Polycyclic Fluoroaromatic Compounds III"; Harrison et al.

*Primary Examiner*—Richard K. Seidel

*Attorney, Agent, or Firm*—Geoffrey L. Chase; James C. Simmons; William F. Marsh

[57] ABSTRACT

Pattern material, such as wax, is removed from an investment casting mold by vapor phase-condensation heating with a fluorochemical boiling at a temperature above the melting point of the pattern material.

10 Claims, No Drawings

REMOVING PATTERN MATERIAL FROM INVESTMENT CASTING MOLDS

TECHNICAL FIELD

The present invention is directed to removal of pattern material such as wax, resins, plastics and low melting point metals from ceramic investment casting molds by vapor phase-condensation heating with fluorochemicals having a boiling point above the melting point of the pattern material. More specifically, the present invention is directed to such techniques using various perfluorocarbons whose boiling point is determined to be marginally above the melting point of the particular pattern material used in the investment casting mold process.

BACKGROUND OF THE PRIOR ART

The use of investment casting molding is well documented in the prior art. This technique is also referred to as the lost wax process. This type of molding technique is advantageous for delicate and complex component geometry fabrications such as dental prosthesis, miniaturization components and high performance components for aerospace and munitions where fastenings of complex geometries are not desirable.

The process of investment casting molding generally includes the steps of assembling wax preforms to a sprue, administering ceramic to the outside of the wax assemblage, inversion of the assemblage and heating to remove the wax leaving the desired cavity geometry, casting of molten metal into the righted mold cavity and destruction of the mold and finishing of the cast product components to remove sprue connections and casting defects.

Such an investment casting molding technique is set forth in U.S. Pat. No. 4,240,493 which also discloses at column 3, line 22, that the wax pattern material can be removed using a steam-fired autoclave, wherein steam is the appropriate agent for the heating, melting and thus removal of the wax from the mold cavity.

It is identified in U.S. Pat. No. 4,700,760 that in investment casting molding, temperatures may be as high as the range of 900° to 1200° F. to facilitate the melting out of wax or plastic preforms and their attendant sprue rods.

U.S. Pat. No. 4,777,996 describes the lost wax process wherein the disadvantages of wax pattern removal using traditional heating is set forth. At column 2, line 9 through 13, it is identified that burning out of wax from an investment cast molding creates environmental considerations due to the large amount of wax that is necessarily burned. Such burnout in addition to melting of the wax is necessary to insure complete removal of the wax, so as to avoid molding defects and mold cracking that occur when ensuing hot metal is poured into the investment casting mold.

In addition to the removal of pattern material, such as wax, by a melting operation, U.S. Pat. No. 4,691,754 identifies that some pattern material is gasified at destructive temperatures induced by the molten metal actually being introduced into the investment casting mold during casting. This technique suffers from control over the evolution of the gasified pattern material. Although the patent describes that the gas can be absorbed by the mold, in fact total gas dissipation is not complete without some possible molding defects such as porosity formation in casting which is considered a defect.

U.S. Pat. No. 4,651,799 is directed to investment casting molds and identifies at column 7, line 18 through 27, that in the autoclave where the wax is melted out of the mold, a significant differential in the appropriate temperature exists, such that the melting point of the wax is at approximately 160° F., while the autoclave temperature is generally about 340° F. Such high temperatures of a traditional autoclave induce problems in wax destruction, and mold cracking from the differential melting and expansion of the interiorly-contained wax prior to that portion of the wax located near the sprue orifice providing an outlet from the cavity in the mold.

U.S. Pat. No. 4,603,728 discloses the problem in the lost wax process, wherein varying temperatures are experienced during wax removal with attendant complications and damage to the mold. Such concerns are identified at column 2, line 21 through 28 of the patent.

U.S. Pat. No. , 4,356,859 recounts the problem with melting out wax from an investment casting mold, wherein the wax expands and creates cracks and defects in the mold. It is identified that steam heat lessens the degree of mold defects introduced during the wax removal process. However, steam heat is limited in the temperatures to which it can be used and therefore, its flexibility in being matched with particular wax, resin, metal or plastic pattern material.

Various fluorocarbons are known in the prior art, such as those recited in U.S. Pat. No. 2,459,780 which describes the heat transfer capabilities of fully fluorinated and fully saturated carbon compounds.

These compounds are additionally disclosed in TETRAHYDRAN, 1963, volume 19, page 1893 through 1899 and an article entitled "Polycyclic Fluoroaromatic Compounds III", Harrison, et al.

The use of heating solder for vapor phase soldering using fluorocarbons has been disclosed in U.K. patent application No. GP 2110204A.

Additional fluorocarbons useful for vapor phase soldering are identified in U.K. patent application No. GP 2194231A.

The use of perfluorotetradecahydrophenanthrene has been set forth in U.S. Pat. No. 4,549,686.

The present invention overcomes the difficulties in appropriate heating of specific melting point waxes, resins or plastics and the uniform application of heat to intricate investment casting molds as set forth below.

BRIEF SUMMARY OF THE INVENTION

The present invention is a method of removing a relatively lower melting point pattern material from a relatively higher temperature stable investment casting mold comprising; heating the mold containing the pattern material in the vapor phase of a fluorochemical having a boiling point above the melting point of the pattern material to condense the vapor on the pattern material and transfer the latent heat of vaporization of the fluorochemical to the pattern material, melting the pattern material for facilitating removal from the mold, and removing the melted pattern material from the mold.

Preferably, the fluorochemical is a fluorocarbon. Optimally, the fluorochemical is a perfluorocarbon.

Preferably, the fluorochemical is selected from the group consisting of: perfluorodecalin, perfluoromethyldecalin, perfluorodimethyldecalin, perfluoroisopropyldecalin, perfluorotetradecahydrophenanthrene, perfluorodiisopropyldecalin, perfluoro-1,1-bis (3,4-dimethylcyclohexyl) ethene and mixtures thereof.

Preferably, the pattern material is selected from the group consisting of wax, resin, plastic, metal or mixtures thereof.

Preferably, the investment casting mold is ceramic. Preferably, the melted pattern material is removed by draining the mold by gravity or centrifugal force.

DETAILED DESCRIPTION OF THE INVENTION

The present invention is directed to the vapor phase-condensation heating of pattern material from the lost wax on investment casting technique, utilizing fluorochemicals, preferably perfluorinated carbon fluids, for the melting or removal of wax, resin, metal or plastic pattern material from the casting molds. The fluorochemicals, such as perfluorinated carbon fluids, lend themselves to this application of vapor phase-condensation heating due to the fluorochemicals unique physical properties. These properties include high boiling points relative to steam, relative inertness to pattern materials and investment cast ceramic components and temperature stability during long periods of heating and reheating in continuous operation for investment casting molding operations. The vapor of the fluorochemicals is also relatively dense in relation to air, so as to avoid fluid losses by evaporation away from the workstation. The fluorochemicals can be tailored to have specific temperature application to the specific wax, resin, metal or plastic utilizing the investment casting operation, rather than relying on a narrow band of temperatures, such as would be available from steam under ambient pressures. The selection of different fluorochemical compounds allows for the matching of the boiling point and thus the temperature of the fluorochemical with the particular wax, resin, metal or plastic utilized as the pattern material.

In the present invention, investment casting molding (lost wax) of metals is achieved by casting molten metal into a mold produced by surrounding (investment) an expendable pattern material (lost wax) with a refractory slurry that sets at room temperature. The pattern which is usually selected from wax, resin, plastic or frozen mercury, is then melted or burned out of the mold, leaving the mold cavity.

The basic production technique for investment casting involves the production of a wax pattern, which is then attached to a sprue or central conduit of similar wax, resin or plastic. When the patterns are connected to the central sprue, the resulting pattern clusters are dipped in a ceramic slurry. Refractory grain can be sifted onto the coated patterns. These steps are repeated several times to obtain the desired shell thickness. The pattern material is melted out of the mold using the condensing hot vapors of a boiling bath of, preferably, a perfluorocarbon material. The ceramic coated pattern cluster can then be set in sand for the casting operation.

As is appreciated by those working with boiling fluids, the vapor phase over a boiling bath of liquid is at the temperature of the boiling point of the liquid and constitutes a steady even heat source. When the pattern material of the investment casting mold is bathed in the vapor phase of this boiling perfluorocarbon, the hot vapors condense on the cooler investment casting mold and pattern material, transferring the latent heat of vaporization from the vapor phase perfluorocarbon to the mold and pattern material. This results in the heating of the mold and pattern material uniformly at a temperature no greater than the boiling point of the selected perfluorocarbon.

Additionally, as wax or pattern material is removed from the mold cavity, the vapor is allowed to proceed into all of the various intricate concavities of the mold to efficiently heat, melt and remove wax. Yet another advantage of the present invention is that the wax is melted out from the external sprue orifice surface inward into the cavity so that undue heat buildup or expansion of melted interior wax less likely to occur as in the typical autoclave. As a result, the vapor phase-condensation heating with the perfluorocarbons of the present invention avoid undue hot spots or high temperatures beyond that absolutely necessary to melt the wax, and the wax or pattern material is melted and removed only as it is freely available for removal in the cavity of the mold. The condensed phase of the perfluorocarbon also has the ability to provide a solvent action on the pattern material in the mold, wherein the condensed liquid phase of the perfluorocarbon can assist in the drainage of the wax in its molten state from the mold interior surface.

The vapor phase-condensation heating of the investment casting mold with pattern material residing therein is conducted by placing the mold assemblage above a bath of liquid perfluorocarbon, which is heated to its boiling point typically using electric heating coils or natural gas retorts to allow the vaporizing perfluorocarbon to rise up around the mold assemblage, within an appropriate container, to heat the mold assemblage. To avoid loss of perfluorocarbon vapors despite their relative greater density than air, condensing coils are situated above the liquid bath and the location of the mold assemblage. However, it should be appreciated that the vapors of the various contemplated perfluorocarbons are inert and of low toxicity to any attendant human operators of the molding process.

The use of the vapor phase of boiling perfluorocarbon allows rapid heating to a preset temperature, to provide uniform and safe heating independent of mold cavity geometry and mold cavity size.

The present invention performs vapor phase-condensation heating and melt out of pattern material from investment casting molds with preferably perfluorocarbon fluids. Perfluorocarbon fluids lend themselves to melt out in investment casting mold, due to their unique physical property. A fixed boiling point above the specified melting point of the wax, resin, metal or plastic pattern material, a high rate of heat transfer, and high thermal stability allow for uniform temperature maintenance during vapor phase-condensation heating.

The term fluorocarbon as used herein is defined as a carbon compound having at least a single fluorine replacing hydrogen in a bond with a carbon. Thus, fluorocarbons, as used herein, may include aromatic and non-aromatic hydrocarbons which have been at least partially fluorinated, wherein at least some hydrogen is substituted with fluorine. The term perfluorocarbon, as used herein, means a carbon compound which is fully fluorinated and has no hydrogen or unsaturation. Thus, the perfluorocarbons contain carbon and fluorine without hydrogen or double bonds. Because the nomenclature for this relatively new group of compounds has not been standardized and is subject to further developments, there is at least some general agreement in the art that specific perfluorocarbons can be named by the nomenclature perfluoro, followed by an aromatic precursor designation. For example, perfluorophenanthrene actually is used to designate phenanthrene which has been completely deprived of hydrogen and unsaturating double bonds and comprises a fully fluorine substituted condensed ring structure of three cyclohexyl groups. Accordingly, for the purpose of this invention, the term perfluorocarbon will indicate total fluorine replacement and total saturation of any aromatic structure despite the use of aromatic nomenclature to designate the hydrocarbon precursor.

Examples of appropriate fluorocarbon that can be utilized in the present invention include, perfluorodecalin which boils at approximately 142° C. (287.6° F.), perfluoromethyldecalin which boils at approximately 160° C. (320 F.), perfluorodimethyldecalin which boils at approximately 180° C. (356° F.), perfluoroisopropyldecalin which boils at approximately 200° C. (392° F.), perfluorotetradecahydrophenanthrene which boils at approximately 215° C. (419° F.), perfluorodiisopropyldecalin which boils at approximately 240° F. (464° F.), and perfluoro-1,1-bis (3,4-dimethylcyclohexyl)ethane, which boils at approximately 260° C. (500° F.).

The physical properties of perfluorocarbon fluids make them an ideal fit for melt out in investment casting molds. These fluids have tight boiling points and high thermal stability in the desired melt out temperature range for traditional waxes, resins, metals and plastics. The fluids are able to provide uniform temperature for vapor phase-condensation heating. The fluids are classified as nonhazardous and they do not provide any significant environmental concerns in the workplace. The melt out temperature of the investment casting mold can be varied by selecting the appropriate perfluorinated fluid or mixtures thereof. The required vapor phase-condensation heating time and temperature are ascertained by the applicable specification for the appropriate pattern material comprising wax, resin, metal or plastic.

Various materials can be utilized for vapor phase-condensation heating including the traditional wax materials of soft, straight-chain aliphatic hydrocarbons which are soluble in pentane. Several of such commercially available waxes have the following characteristics:

TABLE 1

| Wax | Melting Point (°C.) | Boiling Point (°C.) |
|---|---|---|
| #101 | 55.0 | 285 |
| #102 | 58.4 | 290 |
| #103 | 61.0 | 300 |
| #104 | 65.0 | 310 |

Specific advantages of the present invention of melt out of pattern material using vapor phase-condensation heating with perfluorocarbons, includes the advantages of condensation heat transfer which is rapid uniform and relatively independent of geometry, thus making the process essentially facility and operator independent. The vapor state of the vapor phase-condensation heating of the present invention allows for high levels of heat transfer at a much higher rate than previously ascertained. In addition, the vapor phase is able to follow the path of the interior mold walls as the wax is removed, so as to heat only that wax which is readily and easily removed while the condensing vapor of the perfluorocarbon assists in the drainage of the wax from the molds. This expedites the removal of wax and also insures a high rate of wax removal.

The process of the present invention will be described with reference to an example of the preferred embodiment.

EXAMPLE 1

The experimental lost wax process or investment casting molding includes equipment for the removal of wax from investment casting molds consisting of a vapor phase-condensation heating chamber with an associated control panel, wherein the chamber is connected to a supply of the appropriately matched boiling point perfluorocarbon.

The vapor phase-condensation heating unit consists of an insulated stainless steel chamber complete with a low watt-density electric immersion heater, cooling water filled condensing coils and electrical panel with associated control equipment. Nine immersion heaters of 2.5 kilowatt capacity are located in the chamber sump and are used to boil the perfluorocarbon fluid. Two sets of one-half inch outside diameter stainless steel cooling coils are located in the chamber overhead to condense the perfluorocarbon vapors and maintain the vapor phase zone at a fixed height. Several type "J" thermocouples are located throughout the chamber to monitor heater coil temperature, perfluorocarbon liquid temperature and vapor phase zone temperature, both above and below the condensing coils.

The electrical control panel houses the proportional temperature control and process interlocks for the system. The power supply to the heating coils is varied by the controller to maintain a set temperature in the vapor phase zone below the condensing coils. A thermocouple mounted on the heater coil is connected to a high temperature interlock for the heater coil power. Water cooling coils are strategically placed to minimize vapor/fluid loss. Electric immersion heaters are located in the bottom of the chamber to facilitate vaporization.

Liquid perfluorochemical is heated and vaporized inside a stainless steel tank by an electric immersion heater. Cooling coils are employed at the top of the tank to condense and contain the fluid perfluorocarbon.

An investment casting mold to be processed can be transferred through or lowered into the vapor region. This area corresponds to the distance between the liquid level and the cooling coils. The molds can be held in the above described vapor phase zone for a designated period of time depending on size and mass. The perfluorocarbon vapor phase will shroud the entire mold and will provide uniform heating of the mold and the pattern material or wax. Both the interior as well as the exterior will be subject to the rapid heating of condensation heat transfer. Removal of the wax from the investment casting molds inserted into the chamber will occur rapidly by gravity drainage of the wax in the mold cavity, while the mold is in an inverted position within the vapor phase-condensation heating chamber.

An investment casting mold comprising a 6 inch × 12 inch × 12 inch dimensional mold, was transferred into the vapor phase-condensation heating chamber partially filled with liquid perfluorocarbon (perfluorodecalin at 142° C.), with the remainder being filled with perfluorocarbon vapor. The mold was suspended in the vapor phase zone for ten minutes under the above-described procedure and conditions. During the time interval, the wax was removed from inside the mold. The wax was separately collected for disposal or reuse.

Inspection of the mold revealed a clean wax-free surface on the mold interiors where the wax or pattern material had been placed.

The present invention provides improved processing for investment casting molds to remove pattern material such as wax, resin, metal or plastics. The vapor phase-condensation heating process allows for high-rate heat transfer, while providing accurate upper limit control on the heat that any part of the investment casting mold experiences. The perfluorocarbon materials provide safe, nontoxic, inert materials which avoid degradation over long thermal cycling, which perfluorocarbons have a relative high density in the vapor phase to avoid losses into the atmosphere or environment. The vapors of the perfluorocarbon materials also exhibit enhanced capability to heat pattern material at the surface exposed to the exterior, so as to avoid internal pressures of isolated pattern material melting or volatilization, and such perfluorocarbon vapors readily follow intricate interior cavity geometries of investment casting molds, while facilitating the drainage of the melting pattern material to the exterior of the investment casting mold. These attributes are unrealized in traditional direct fired furnaces which generally requires very high temperatures and subjects the investment casting mold itself to thermal stressing. The use of vapor phase-condensation heating with perfluorocarbons is more advantageous than the use of steam, because of the greater variability in the temperature that can be selected by utilization of different perfluorocarbon materials, degreasing capability and a greater inertness and higher density vapor for the overall compatibility with the process of melt out in investment casting molds.

The advantages of the present invention vapor phase-condensation heating with perfluorocarbons over the traditional techniques of steam autoclaving and direct fire heating are set forth below:

TABLE 2

| Removal Process | Rejection Rate | Continuous Processing | Heating Rate |
|---|---|---|---|
| Steam autoclave | low | no | fast |
| Direct fire heating | high | yes | slow |
| Vapor phase-condensation heating with perfluorocarbons | low | yes | fast |

As can be seen, only the vapor phase-condensation heating with perfluorocarbons has desirable traits in all three of the essential parameters of pattern material removal from investment casting molds.

The present invention has been set forth with regard to a specific embodiment, however, the scope of the invention should be ascertained from the claims which follow.

We claim:

1. A method of removing a relatively lower melting point pattern material from a relatively higher temperature stable investment casting mold comprising; heating said mold containing said pattern material in the vapor phase of a fluorochemical having a boiling point above the melting point of said pattern material to condense said vapor on said pattern material and transfer the latent heat of vaporization of said fluorochemical to said pattern material, melting the pattern material for facilitating removal from said mold, and removing the melted pattern material from said mold.

2. The method of claim 1 wherein said fluorochemical is a fluorocarbon.

3. The method of claim 1 wherein said fluorochemical is a perfluorocarbon.

4. The method of claim 1 wherein said fluorochemical is selected from the group consisting of: perfluorodecalin, perfluoromethyldecalin, perfluorodimethyldecalin, perfluoroisopropyldecalin, perfluorotetradecahydrophenanthrene, perfluorodiisopropyldecalin, perfluoro-1,1-bis(3,4-dimethylcyclohexyl)ethene and mixtures thereof.

5. The method of claim 1 wherein said pattern material is wax.

6. The method of claim 1 wherein said pattern material is plastic.

7. The method of claim 1 wherein said pattern material is metal.

8. The method of claim 1 wherein said investment casting mold is ceramic.

9. The method of claim 1 wherein said melted pattern material is removed from said mold by gravity drainage.

10. The method of claim 1 wherein said melted pattern material is removed from said mold by centrifugal force drainage.

* * * * *